US011833571B1

(12) United States Patent
Noonan et al.

(10) Patent No.: US 11,833,571 B1
(45) Date of Patent: Dec. 5, 2023

(54) RECEIVER EXTENSION AND A METHOD OF MANUFACTURING IT

(71) Applicant: F.M. Products Inc, Boise, ID (US)

(72) Inventors: Paul T. Noonan, Boise, ID (US); Aaron Neal Trout, Boise, ID (US)

(73) Assignee: F.M. Products Inc., Boise, ID (US)

( * ) Notice: Subject to any disclaimer, the term of this patent is extended or adjusted under 35 U.S.C. 154(b) by 0 days.

(21) Appl. No.: 17/515,156

(22) Filed: Oct. 29, 2021

Related U.S. Application Data

(60) Provisional application No. 63/108,310, filed on Oct. 31, 2020.

(51) Int. Cl.
*B21C 23/08* (2006.01)
*B21D 51/16* (2006.01)
*F41A 3/66* (2006.01)

(52) U.S. Cl.
CPC ..... *B21D 51/16* (2013.01); *B21C 23/08* (2013.01); *F41A 3/66* (2013.01)

(58) Field of Classification Search
CPC ..... B21C 37/152; B21C 37/155; B21C 23/10; B21C 23/085; B21C 23/08; B21C 23/183; B21C 23/142
See application file for complete search history.

(56) References Cited

U.S. PATENT DOCUMENTS 3,205,692 A * 9/1965 Kemppinen ..... B21C 23/085 72/271
3,267,712 A * 8/1966 Atkin ..... B21C 23/10 72/260
2007/0137277 A1* 6/2007 Tye ..... B21C 23/085 72/260

OTHER PUBLICATIONS

AR Buffer Tube Machining Video Screenshots (https://www.youtube.com/watch?v=FW2Xo7QgTkM); C&S Machine & Manufacturing Corporation; May 21, 2020 (Year: 2020).*

* cited by examiner

*Primary Examiner* — Debra M Sullivan

(57) ABSTRACT

A method for manufacturing is disclosed. The method forms a hollow pipe using an extrusion process, the hollow pipe contains a main body, a through aperture, and a protrusions running along the entire length of the main body, forms internal threads inside the through aperture, forms an elongated bottom member from the protrusion, wherein the elongated bottom member contains a recessed channel and one or more recesses, wherein the elongated bottom member runs along a portion of the main body, forms external threads along the main body.

1 Claim, 11 Drawing Sheets

RECEIVER EXTENSION AND A METHOD OF MANUFACTURING IT

CROSS REFERENCE TO RELATED APPLICATIONS

This application claims the benefit of U.S. Provisional Application No. 63/108,310, filed on Oct. 31, 2020, which is incorporated herein by reference in its entirety.

FIELD

The present invention relates to firearm manufacture. More particularly, the present invention relates to a firearm receiver extension and a method of manufacturing it.

BACKGROUND

The AR15/M16 family of firearms and their derivatives, have butt stocks that are attached to the weapon by means of a tube which projects from the rear of the weapon, known as the buffer tube. Buffer tubes typically have a series of even spaced holes along the bottom of the tube, and the butt stock is secured by a pin that engages within one of the holes. The spaced holes allow the user to adjust the position of the butt stock to shorten or lengthen the total length of the weapon, or more importantly the distance from the back of the weapon, the butt plate, to the trigger and sight of the weapon to accommodate different sized users. A shorter user will desire a shorter distance from the butt plate to the trigger and sight than a taller user. A properly sized weapon will improve the users ability to aim and fire the weapon.

There are a number of common problems with prior art buffer tubes, including they are expensive to manufacture. Therefore, a need exists for a better type of buffer tube for firearms.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 1:
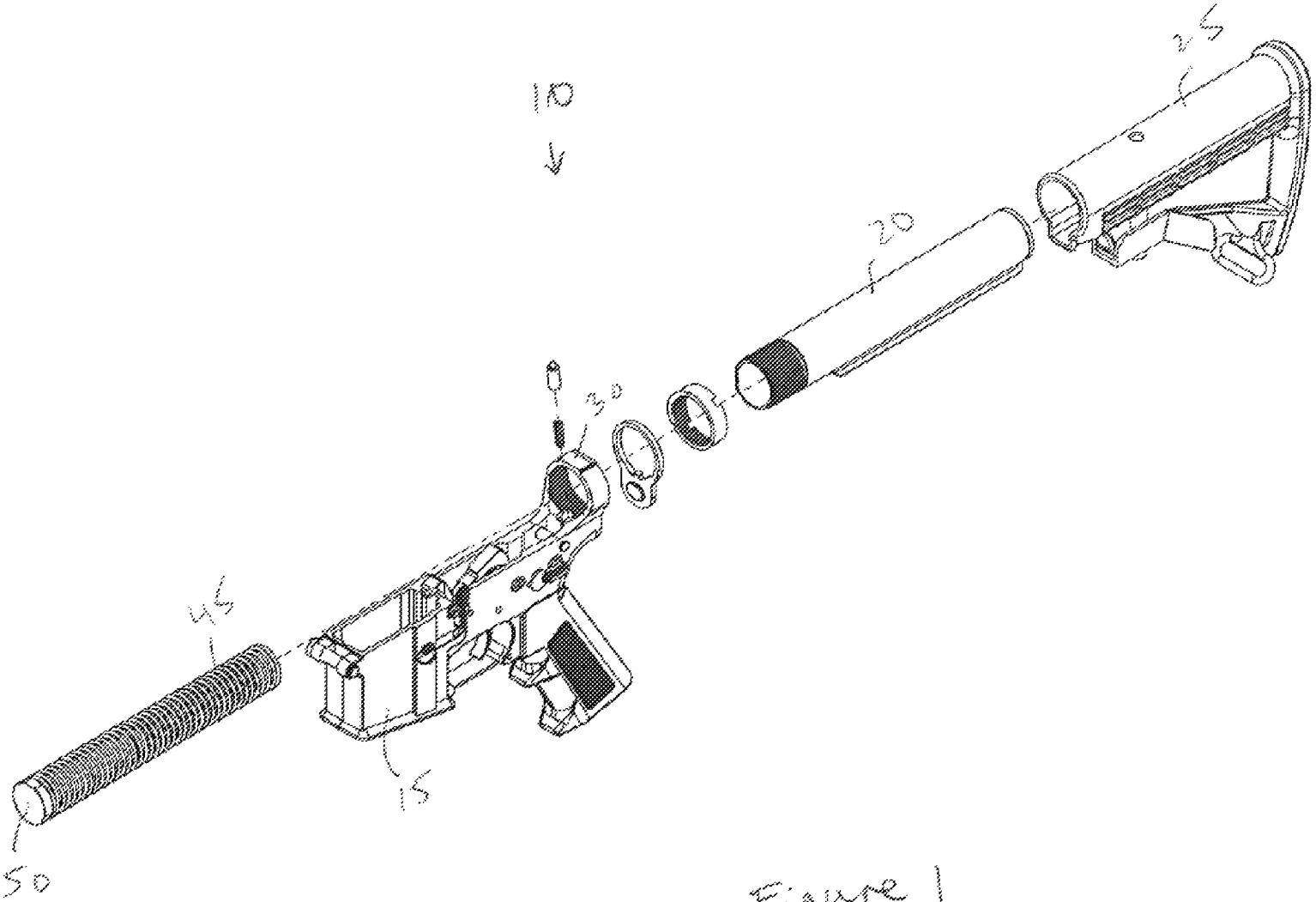
FIG. 1 depicts an exploded, partial view of a firearm according to some embodiments presently disclosed.

Referring to FIG. 1, an exploded view of a portion of a firearm 10 is shown according to some embodiments presently disclosed. The firearm 10 may comprise a lower receiver 15.

The lower receiver 15 comprises an upwardly extending lobe 30. According to some embodiments, the upwardly extending lobe 30 is used to mount a buttstock 25 to the lower receiver 15 and is used to align a receiver extension (i.e. buffer tube) 20 with a bolt carrier (not shown) housed within an upper receiver (not shown). The receiver extension 20 generally houses an action (or recoil) spring 45 and a buffer assembly 50 (shown in FIG. 1). Upon discharge of a round, the bolt carrier within the upper receiver is driven rearward by action of the gas discharged by the firing action. The buffer assembly 50 and the action spring 45 dampen the kickback experienced by a user while also redirecting the firing mechanism back toward the chamber in preparation for firing another round.

Figure 2:
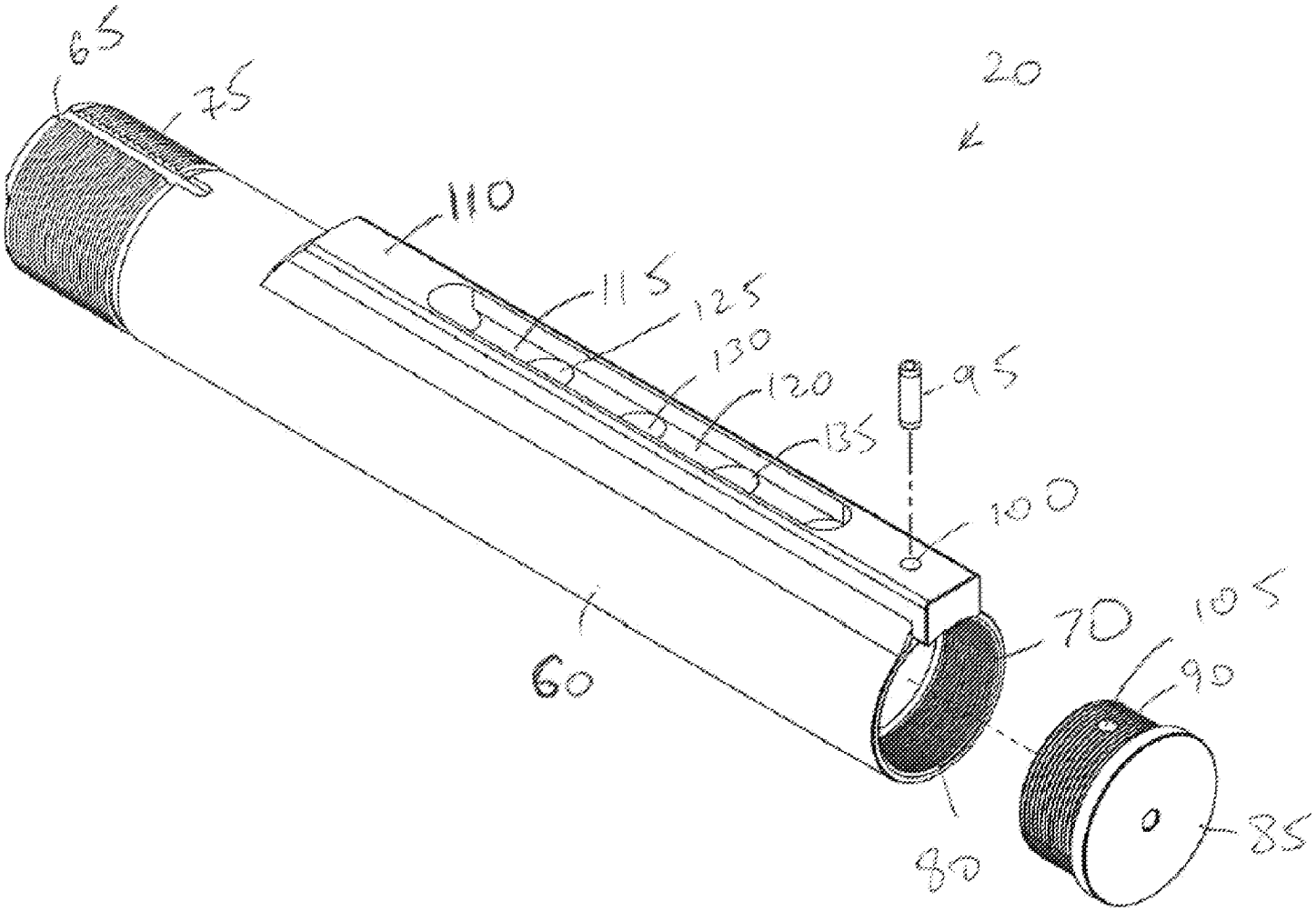
FIG. 2 depicts an exploded view of a receiver extension according to some embodiments presently disclosed.
Figure 3:
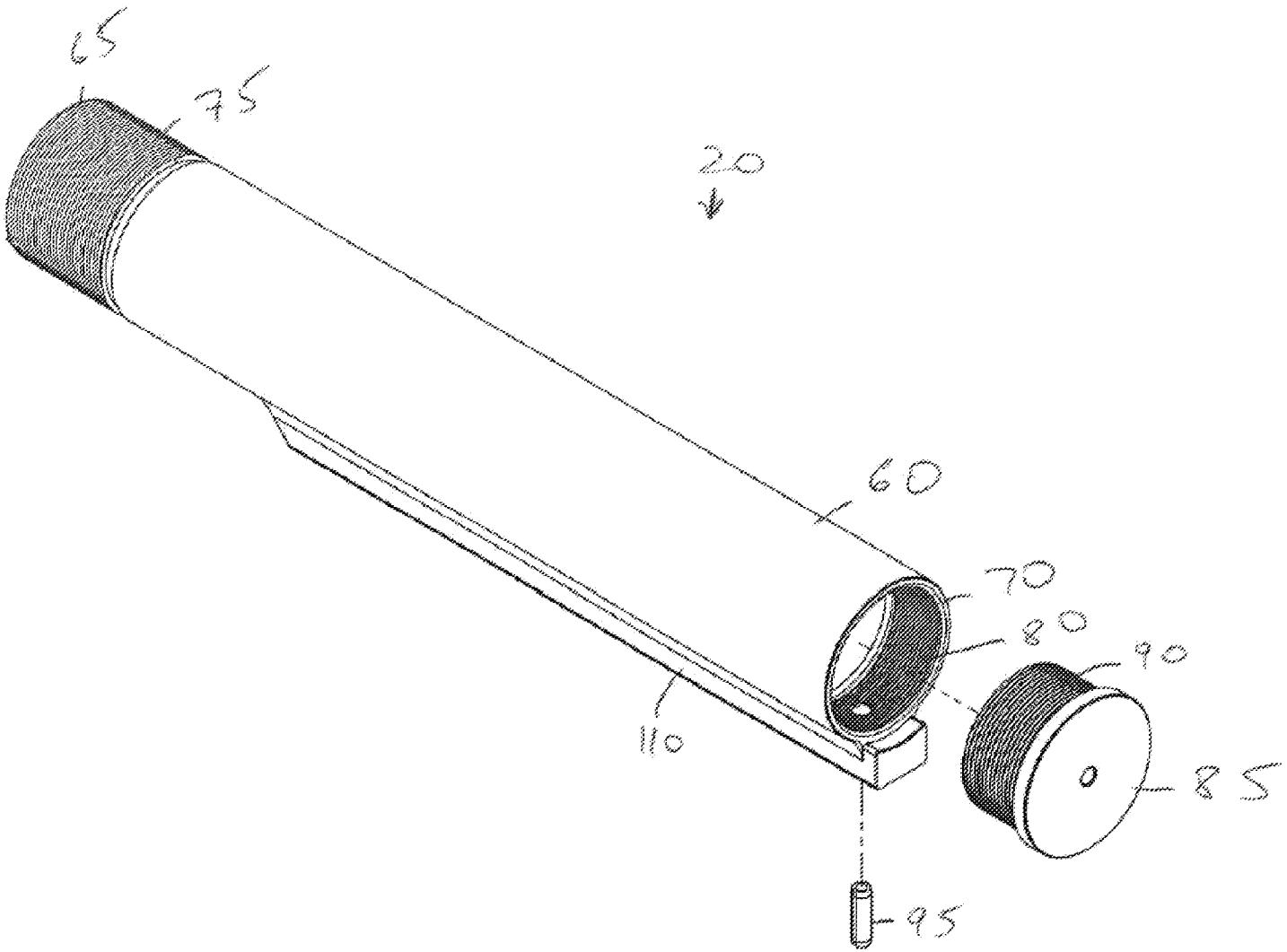
FIG. 3 depicts an exploded view of a receiver extension according to some embodiments presently disclosed.
Figure 4:
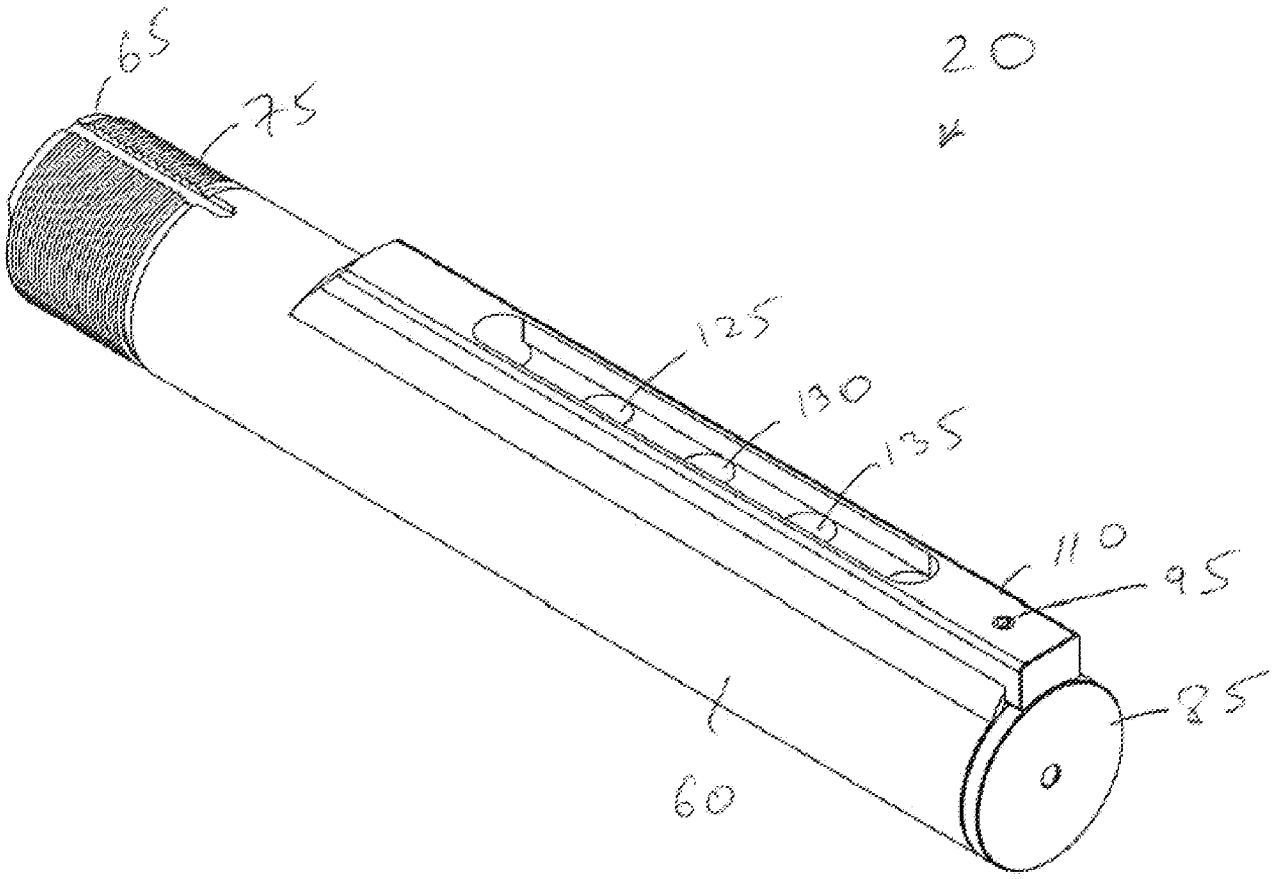
FIG. 4 depicts a receiver extension according to some embodiments presently disclosed.

Referring to FIGS. 2-4, the receiver extension (i.e. buffer tube) 20 is shown according to some embodiments presently disclosed. The buffer tube 20 comprises a housing 60. The housing 60 comprises a first open end 65 and a second open end 70. The first open end 65 may comprise an external thread 75 for coupling the buffer tube 20 with the upwardly extending lobe 30. The buffer tube 20 may further comprise an end cap 85 coupled with the second end 70. According to some embodiments, the end cap 85 is removably coupled with the second end 70.

The second open end 70 may comprise an internal thread 80 for coupling the buffer tube 20 with an external thread 90 of the cap 85. According to some embodiments, the buffer tube 20 may comprise a fastener 95 for coupling the housing 60 with the cap 85. The housing 60 may comprise an aperture 100 for accommodating the fastener 95. The end cap 85 may comprise an aperture 105 for accommodating the fastener 95.

According to some embodiments, the buffer tube 20 may comprise an elongated bottom member 110 provided with a downwardly facing recessed channel 115 exposing a flat surface 120 formed with a lock receiving structure. The lock receiving structure may be defined by a series of spaced a part cylindrical latch pin receiving recesses 125, 130, 135 which serve to establish different axial positions for the sliding stock 25 along the buffer tube 20.

According to some embodiments presently disclosed, the buffer tube 20 may be formed using the following process. According to some embodiments, an extrusion process is used to push a first material through a die to form shape 200 (shown in FIG. 8). The first material may be aluminum, metal, steel, and/or polymer. According to some embodiments, the shape 200 may be cut to desired length. According to some embodiments, the shape 200 is machined to form the housing 60 as shown in FIG. 2.

Figure 9:
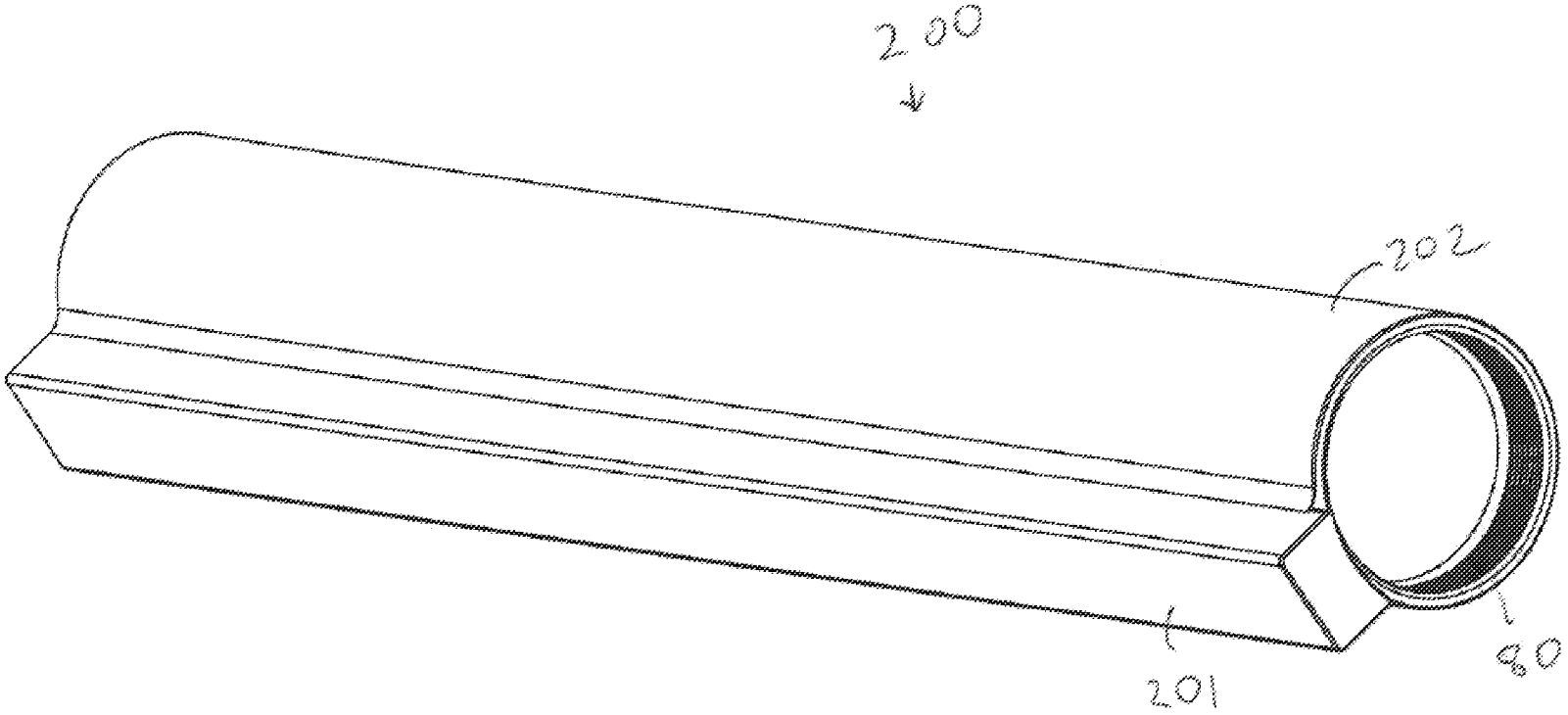
Figure 10:
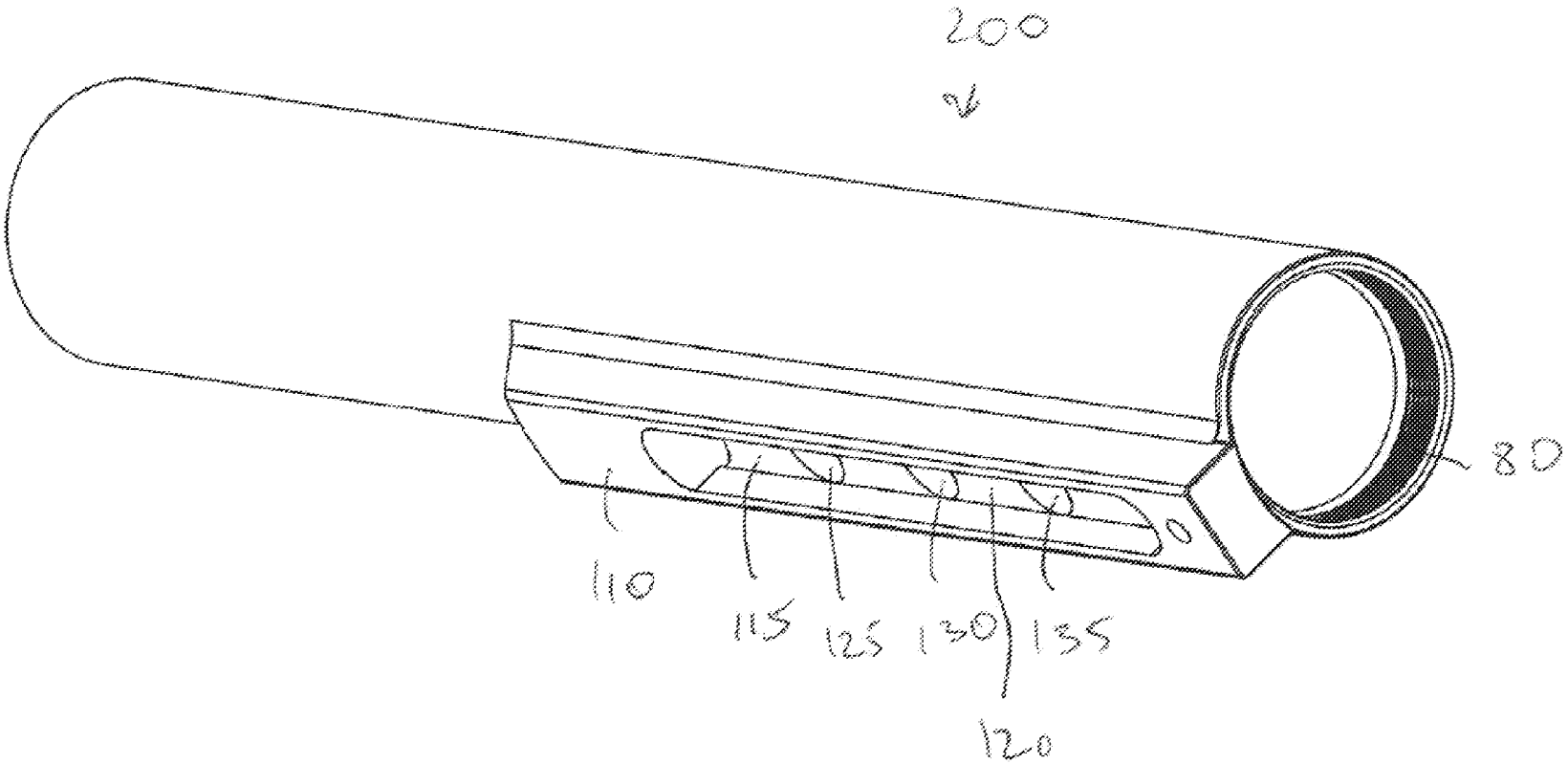
Figure 11:
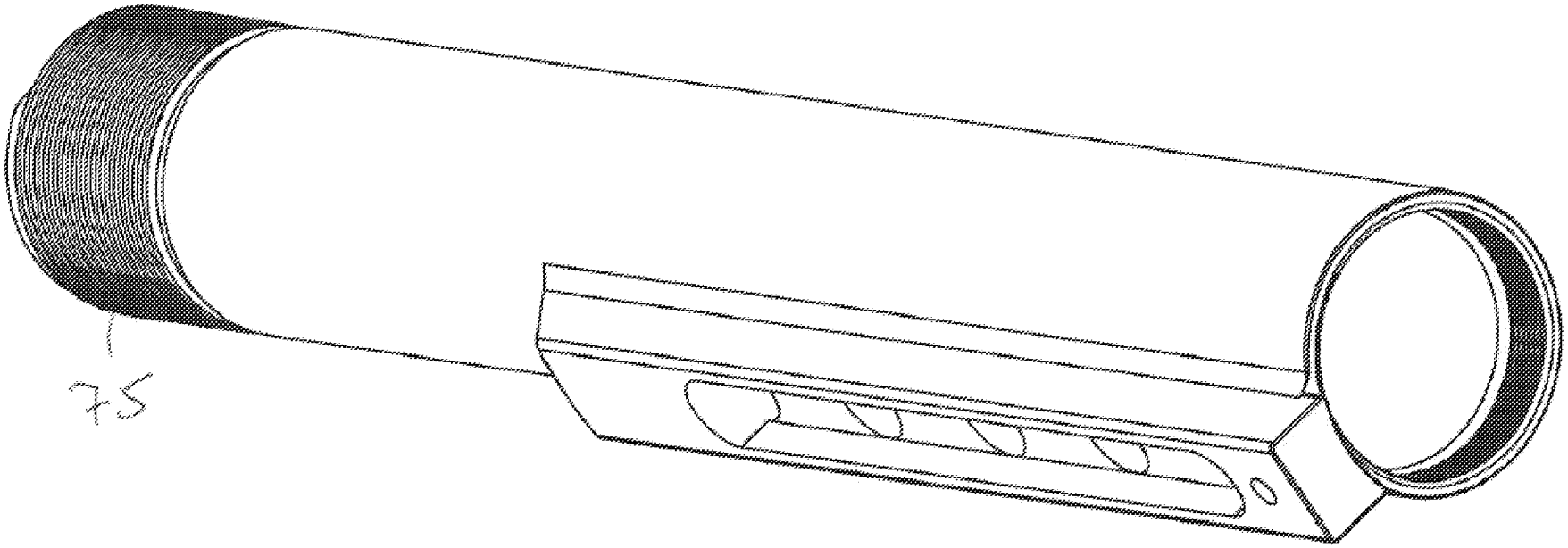

According to some embodiments, the shape 200 is machined to form internal threads 80 as shown in FIG. 9. According to some embodiments, the shape 200 is machined to form the elongated bottom member 110, the recessed channel 115 and the cylindrical latch pin receiving recesses 125, 130, 135 as shown in FIG. 10. According to some embodiments, the shape 200 is machined to form external thread 75 as shown in FIG. 11.

Figure 8:
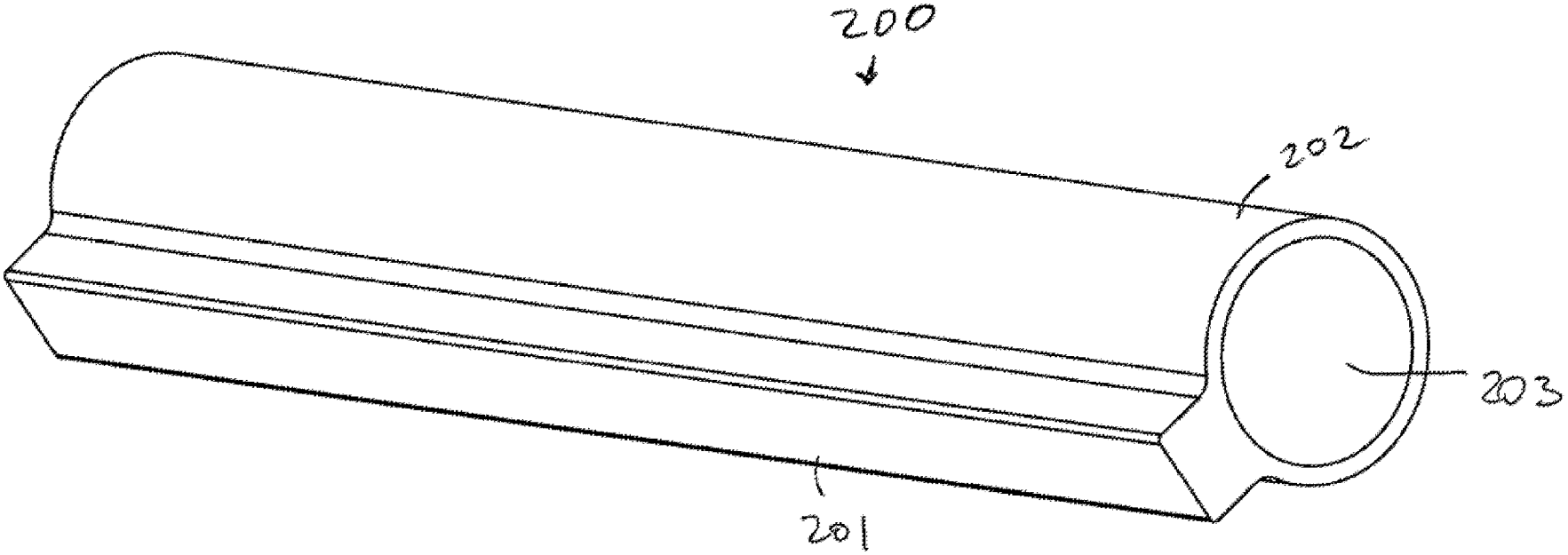
FIGS. 8-11 depict a process according to some embodiments presently disclosed.

According to a method presently disclosed, the buffer tube 20 may be formed using the following process. According to some embodiments, forming a first shape 200 as shown in FIG. 8. The first shape 200 may be formed using an extrusion process where a first material is heated and pushed through a die to form shape 200. The first shape 200 comprises a main body 202 and a protrusion 201 running along the entire length of the main body 202. The first material may be aluminum, metal, steel, and/or polymer. According to some embodiments, the first shape 200 may be cut to desired length. According to some embodiments, the main body 202 is a hollow cylinder. According to some embodiments, the main body 202 comprises a through aperture 203.

According to some embodiments, a second shape 200 formed as shown in FIG. 9. The second shape 200 may be formed by providing internal threads 80 as shown in FIG. 9. The internal thread 80 may be formed using a machining process. The internal thread 80 may be machined. The internal thread 80 are formed in the aperture 203. The internal thread 80 are formed along a portion of an internal surface of the aperture 203.

According to some embodiments, a third shape 200 may be formed as shown in FIG. 10. The third shape 200 is formed by providing the elongated bottom member 110, the recessed channel 115 and the cylindrical latch pin receiving recesses 125, 130, 135 as shown in FIG. 10. The elongated bottom member 110 may be formed by machining the protrusion 201. The recessed channel 115 and the cylindrical latch pin receiving recesses 125, 130, 135 may be formed by machining the elongated bottom member 110.

According to some embodiments, a fourth shape 200 may formed as shown in FIG. 11. The fourth shape 200 may be formed by providing external thread 75 as shown in FIG. 11. The external thread 75 may be formed using a machining process. The external thread 75 may be machined.

Figure 5:
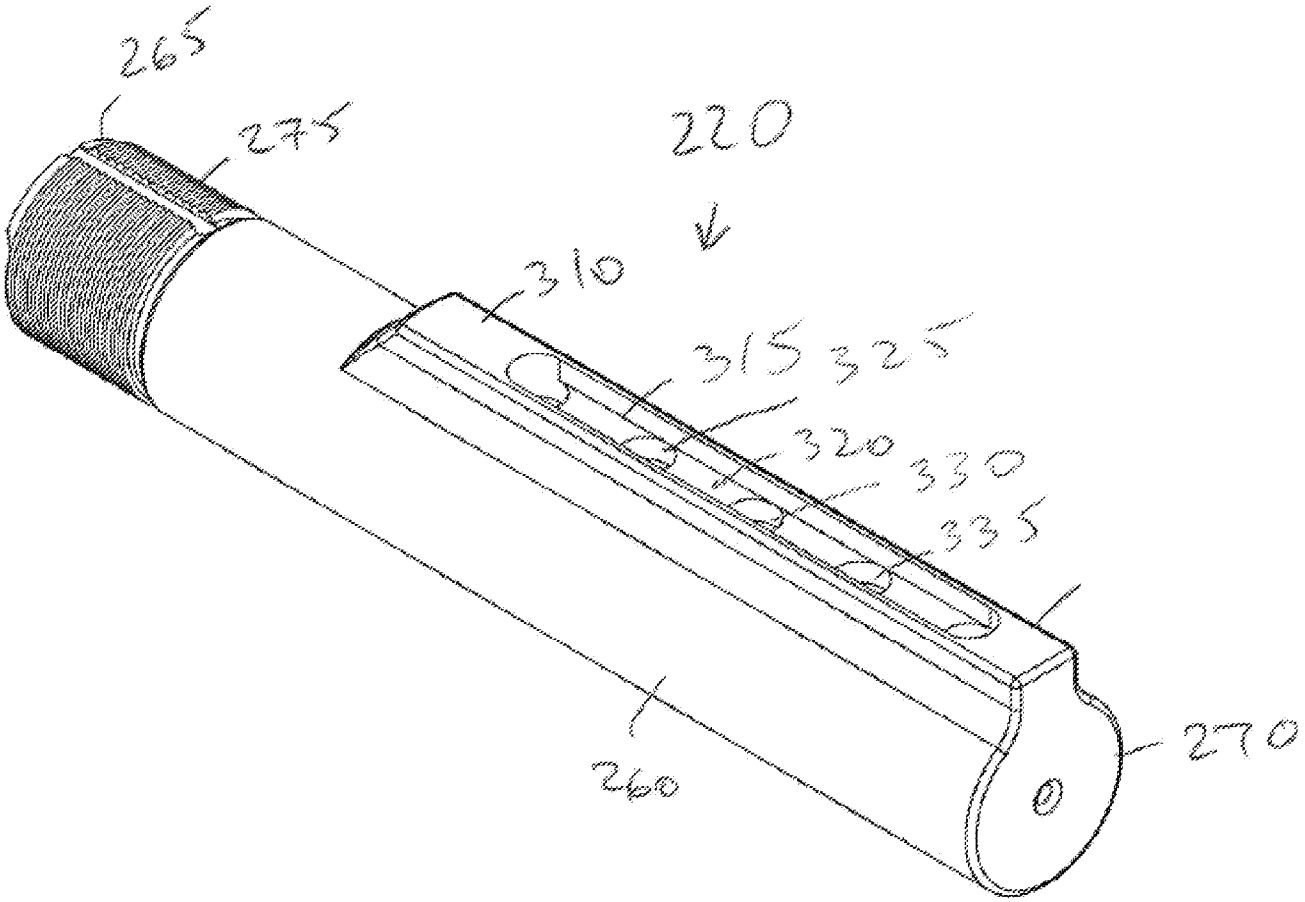
FIG. 5 depicts a receiver extension according to some embodiments presently disclosed.
Figure 6:
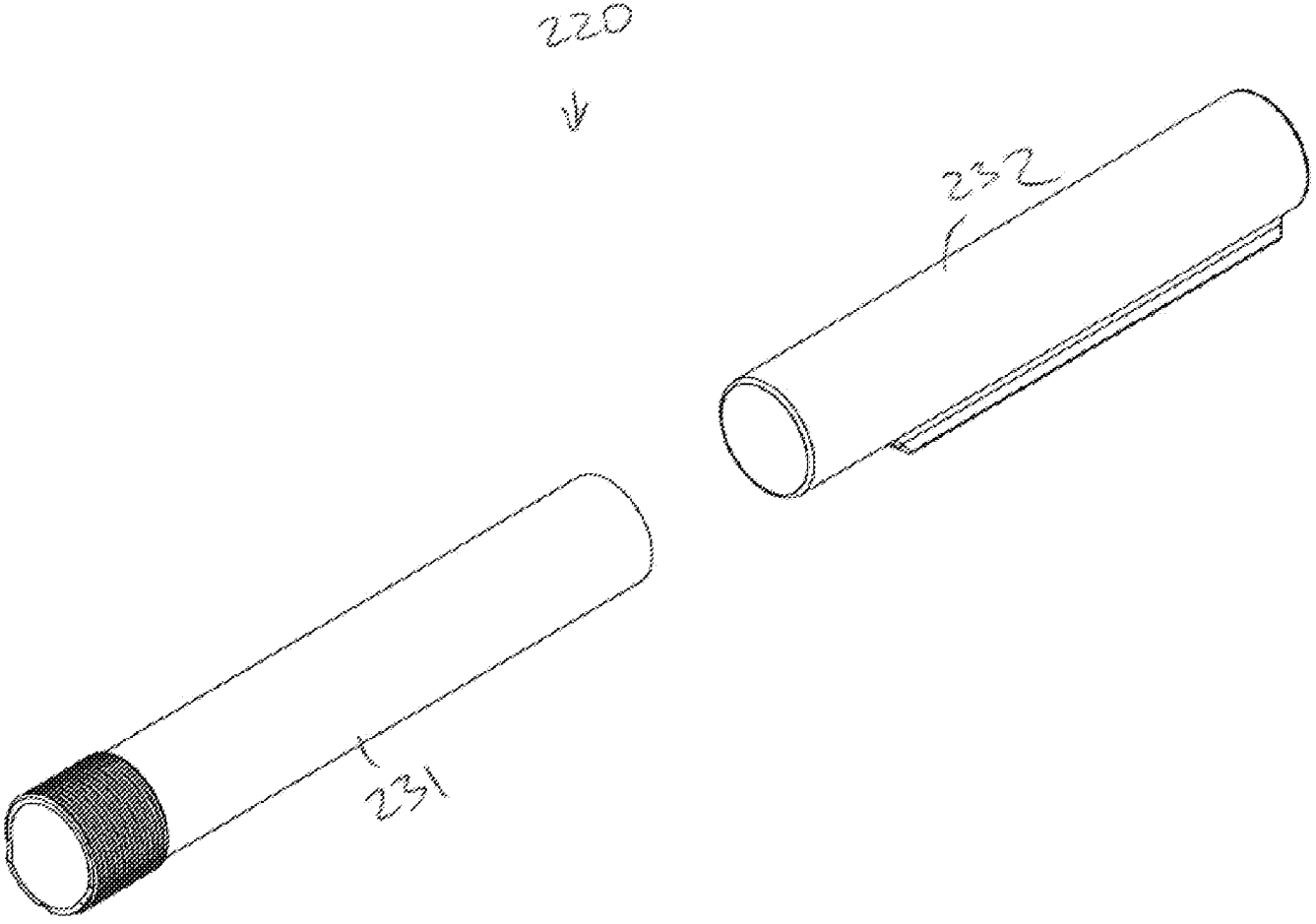
FIG. 6 depicts a receiver extension according to some embodiments presently disclosed.
Figure 7:
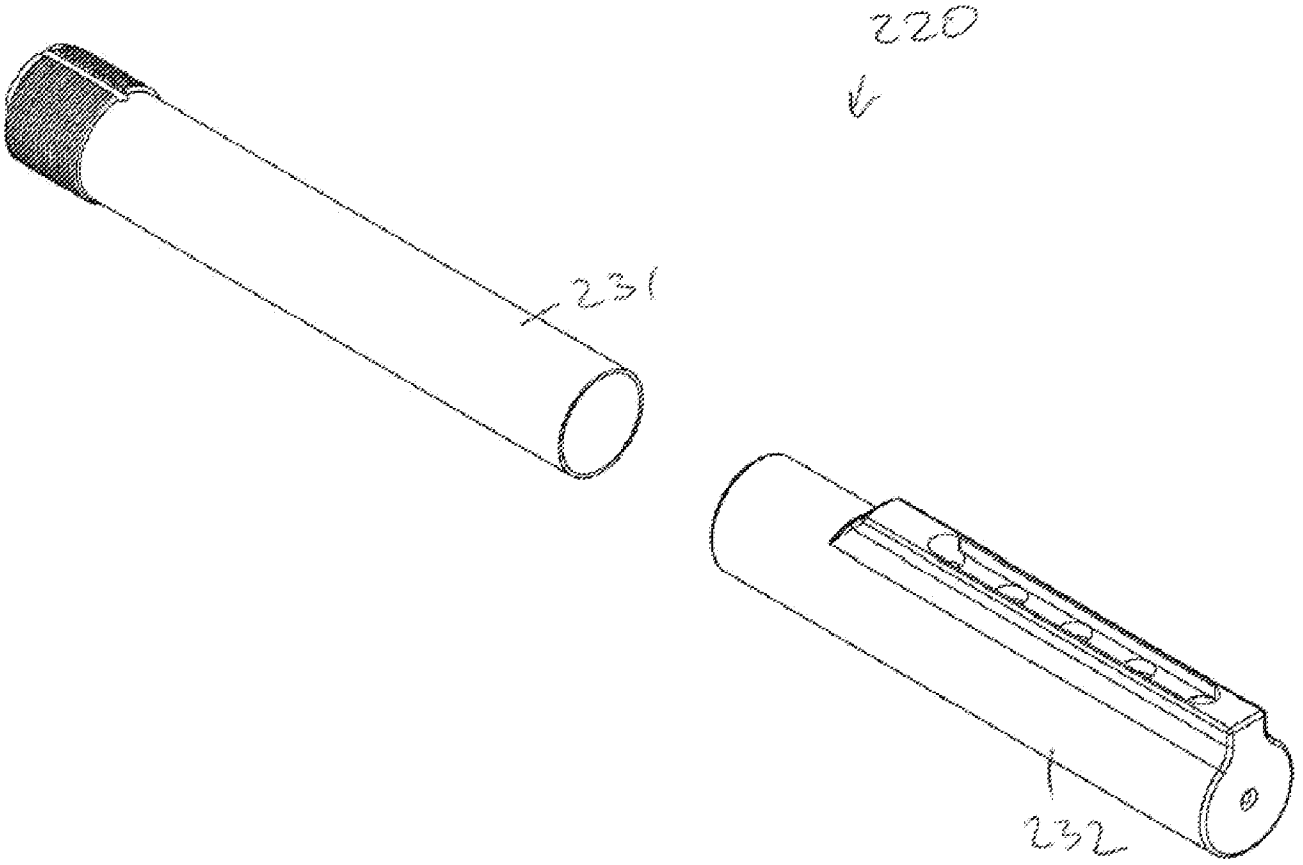
FIG. 7 depicts a receiver extension according to some embodiments presently disclosed.

Referring to FIGS. 5-7, another receiver extension (i.e. buffer tube) 220 is shown according to some embodiments presently disclosed. The buffer tube 220 comprises a housing 260. The housing 260 comprises a first open end 265 and a second closed end 270. The first open end 165 may comprise and external thread 275 for coupling the buffer tube 220 with the upwardly extending lobe 30.

According to some embodiments, the buffer tube 220 may comprise an elongated bottom member 310 provided with a downwardly facing recessed channel 315 exposing a flat surface 320 formed with a lock receiving structure. The lock receiving structure may be defined by a series of spaced a part cylindrical latch pin receiving recesses 325, 330, 335 which serve to establish different axial positions for the sliding stock 25 along the buffer tube 220.

According to some embodiments presently disclosed, the buffer tube 220 may be formed using the following process. According to some embodiments, a hollow (i.e. cylindrically shaped) pipe 231 is provided made out of first material. The first material may be aluminum, metal, steel, and/or polymer. The pipe 231 is machined to form threads 275. The pipe 231 is over molded (i.e. covered) with polymer 232 to create the elongated bottom member 310 with the downwardly facing recessed channel 315 and the recesses 325, 330, 335. Although FIGS. 6-7 show pipe 231 and polymer 232 as separate structures, this is only for explanation purposes. It is to be understood that polymer 232 is formed over the pipe 231 and cannot be removed from the pipe 231 once formed.

According to some embodiments presently disclosed, the first material is steel, aluminum, metal, polymer, and/or sintered metal powder. According to some embodiments presently disclosed, the second material is steel, aluminum, metal, polymer, and/or sintered metal powder. According to some embodiments presently disclosed, the first melting point is lower than the second melting point.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A method comprising:

forming a hollow pipe using an extrusion process, the hollow pipe comprises a main body, a through aperture and a protrusion running along the entire length of the main body;

forming internal threads inside the through aperture;

forming an elongated bottom member from the protrusion, wherein the elongated bottom member comprises a recessed channel and one or more recesses, wherein the elongated bottom member runs along a portion of the main body;

forming external threads along the main body.

* * * * *